US009486030B2

(12) United States Patent
Krissman et al.

(10) Patent No.: US 9,486,030 B2
(45) Date of Patent: Nov. 8, 2016

(54) AUDIO POUCH FOR HELMET

(71) Applicant: The Ketchum Group, Inc., Los Angeles, CA (US)

(72) Inventors: Charles Krissman, Los Angeles, CA (US); Michael Mathe, Napa, CA (US)

(73) Assignee: The Ketchum Group, Inc., Laguna Beach, CA (US)

( * ) Notice: Subject to any disclaimer, the term of this patent is extended or adjusted under 35 U.S.C. 154(b) by 0 days.

(21) Appl. No.: 14/818,133

(22) Filed: Aug. 4, 2015

(65) Prior Publication Data

US 2016/0143385 A1 May 26, 2016

Related U.S. Application Data

(60) Provisional application No. 62/033,591, filed on Aug. 5, 2014, provisional application No. 62/099,814, filed on Jan. 5, 2015.

(51) Int. Cl.
*A42B 3/30* (2006.01)
*H04R 1/10* (2006.01)

(52) U.S. Cl.
CPC ..... *A42B 3/306* (2013.01); *H04R 1/10* (2013.01); *H04R 1/105* (2013.01)

(58) Field of Classification Search
CPC ..... A42B 1/245; A42B 3/30; A42B 3/16; A42B 3/08; A42B 3/306; A42B 3/0406; A42B 3/04; A42B 3/044
USPC ..... 224/181, 575, 576
See application file for complete search history.

(56) References Cited

U.S. PATENT DOCUMENTS

| | | | | |
|---|---|---|---|---|
| 1,628,483 | A | 5/1927 | Wiegand et al. | |
| 1,936,273 | A | 11/1933 | Segal | |
| D194,152 | S | 11/1962 | Noyes et al. | |
| D269,611 | S | 7/1983 | Saito | |
| D292,331 | S | 10/1987 | Bryant | |
| D305,072 | S | 12/1989 | Ferguson | |
| D323,043 | S | 1/1992 | Lofton | |
| D333,659 | S | 3/1993 | Williams | |
| 5,231,704 | A | 8/1993 | Hildenbrand | |
| D351,387 | S | 10/1994 | Roberts | |
| 5,751,825 | A | 5/1998 | Myers et al. | |
| D399,206 | S | 10/1998 | Yasutomi et al. | |
| 5,875,956 | A | 3/1999 | Benarrouch | |
| 5,881,390 | A | 3/1999 | Young | |
| D453,015 | S | 1/2002 | Yuyama | |
| 6,490,729 | B1 * | 12/2002 | Dondero | A42B 3/185 2/10 |
| D495,247 | S | 8/2004 | Keberlein | |
| 6,965,681 | B2 | 11/2005 | Almquist | |

(Continued)

FOREIGN PATENT DOCUMENTS

| | | |
|---|---|---|
| EP | 2160046 A1 | 3/2010 |
| GB | 2435605 | 9/2007 |

*Primary Examiner* — Adam Waggenspack
(74) *Attorney, Agent, or Firm* — Tsircou Law, P.C.

(57) ABSTRACT

An audio pouch is provided that secures an earpiece of a headphone assembly adjacent to the user's ear when worn. The audio pouch includes an inner panel and an outer panel that sandwich an earpiece of the headphone assembly therebetween, such that the earpiece is disposed adjacent to the user's ear when worn. The audio pouch includes attachments that retain helmet straps. The audio pouch is particularly effective with protective helmets having Y-straps extending from the helmet for attaching chinstrap thereto.

9 Claims, 12 Drawing Sheets

(56) References Cited

U.S. PATENT DOCUMENTS

| | | | | |
|---|---|---|---|---|
| 7,155,025 | B1 | 12/2006 | Weffer | |
| 7,395,090 | B2 | 7/2008 | Alden | |
| 7,761,091 | B2 | 7/2010 | Dunn et al. | |
| D623,627 | S | 9/2010 | Alden et al. | |
| D624,057 | S | 9/2010 | Kelly et al. | |
| 7,925,029 | B2 | 4/2011 | Hollemans et al. | |
| D641,003 | S | 7/2011 | Alden | |
| 7,971,282 | B2 | 7/2011 | Berge | |
| 8,001,624 | B1 | 8/2011 | Leedom | |
| 8,014,824 | B2 | 9/2011 | Alden | |
| D650,356 | S | 12/2011 | Alden et al. | |
| D656,129 | S | 3/2012 | Kelly et al. | |
| D665,776 | S | 8/2012 | Alden et al. | |
| D665,777 | S | 8/2012 | Alden et al. | |
| 2002/0003889 | A1 | 1/2002 | Fischer | |
| 2006/0088178 | A1 | 4/2006 | Whelen | |
| 2006/0147052 | A1 | 7/2006 | Wikel et al. | |
| 2006/0212998 | A1 | 9/2006 | Gath | |
| 2008/0058037 | A1 | 3/2008 | Dunn et al. | |
| 2008/0226112 | A1 | 9/2008 | Lin | |
| 2008/0267440 | A1 | 10/2008 | Alden | |
| 2008/0279404 | A1 | 11/2008 | Kuo | |
| 2008/0319562 | A1 | 12/2008 | Forstall | |
| 2009/0323975 | A1 | 12/2009 | Groesch | |
| 2010/0040245 | A1 | 2/2010 | Buil et al. | |
| 2010/0245585 | A1 | 9/2010 | Fisher et al. | |
| 2011/0032071 | A1 | 2/2011 | Tondering | |
| 2011/0164776 | A1 | 7/2011 | Kelly et al. | |
| 2011/0211709 | A1 | 9/2011 | Szolga | |
| 2011/0235819 | A1 | 9/2011 | Alden | |
| 2012/0077438 | A1 | 3/2012 | Jung | |
| 2012/0128172 | A1 | 5/2012 | Alden | |
| 2012/0148080 | A1* | 6/2012 | Kushnirov et al. ..... | A42B 3/30 381/333 |
| 2012/0257775 | A1 | 10/2012 | Siskin et al. | |
| 2012/0275615 | A1 | 11/2012 | Kelly et al. | |
| 2013/0185905 | A1* | 7/2013 | Stiff et al. ..... | A42B 3/04 24/572.1 |

* cited by examiner

AUDIO POUCH FOR HELMET

CROSS REFERENCE TO RELATED APPLICATION

This application is claims benefit of U.S. Application No. 62/033,591, filed Aug. 5, 2014, and U.S. Application No. 62/099,814, filed Jan. 5, 2015, which is herein incorporated by reference.

FIELD OF THE INVENTION

The present invention relates generally to headphone accessories and, more particularly, to an accessory for securing headphones to a helmet.

BACKGROUND OF THE INVENTION

Portable media players have changed the way users incorporate music into their daily lives. Advances in portable media technology have made devices smaller and lighter, allowing users to access music and media content while engaging in nearly any activity. Improvements in media storage capacity also allow users to store and access a substantial amount of media content. In addition, increased battery capacity allows users to use devices for extended periods without having to recharge the device.

It has become increasingly common for people engaging in outdoor activities, particularly skiing and snowboarding, to use portable media players and mobile phones to listen to music. However, both in-ear and over-ear headphones are ill adapted for these activities.

Generally, these activities require, among other things, the use of a helmet or head covering beanie, and goggles. Winter specific headwear is typically designed to partially or completely cover the ears to protect against the cold and wind. In-ear headphones (e.g., earbuds) may cause discomfort due to the pressure exerted by the helmet, beanie, or goggle bands on against the ear. Even if the user adjusts the headgear away from or off the ears, earphones are very likely to fall out while engaging in the activity.

Generally, over-the-ear style headphones completely cover the ear and are positioned over the top of the head of the user. Therefore, a user wearing a helmet, which is commonly worn while snowboarding or skiing, will not be able to use headphones. If the user decides not to wear a helmet, headphones may be worn, but it is too cumbersome and difficult to secure on the user's head while the user is participating in the activity.

In addition, traditional headphones are inconvenient for outdoor activities because they typically connect to the media player or mobile phone by wires. The wires can be entangled with equipment, clothing, and the user's hands and become a great inconvenience to the user. In addition, wires can hinder and restrict the movement of the user's head and neck, preventing the user from safely and comfortably participating in the activity.

Furthermore, using traditional headphones may pose a dangerous risk to people participating in outdoor activities. Although popular and largely enjoyed, skiing and snowboarding is an inherently dangerous activity. A skier or snowboarder should be fully aware of the surrounding environment, especially the sounds of other skiers and snowboarders nearby. Wearing traditional earphones or headphones may pose a significant risk to the user because traditional headphones are designed to block out all ambient noise. Thus, there is a need for skiers and snowboarders to be able to listen to their media player or mobile phone without having all ambient noise being blocked. Moreover, it can be difficult to secure earphones proximate to the ear in a convenient manner that does not otherwise impede proper use of the helmet.

It should, therefore, be appreciate that there remains a need for a device for securing headphones to protective helmet.

SUMMARY OF THE INVENTION

Briefly, and in general terms, an audio pouch is provided that secures an earpiece of a headphone assembly adjacent to the user's ear when worn. The audio pouch includes an inner panel and an outer panel that sandwich helmet straps and an earpiece of the headphone assembly therebetween, such that the earpiece is disposed adjacent to the user's ear when worn. The audio pouch is particularly effective with protective helmets having why straps extending from the helmet for attaching chinstrap thereto.

In an exemplary embodiment, the audio pouch assembly has an audio pouch body that is detachably connectable to y-straps of a protective helmet. The audio pouch body includes an outer panel having an upper edge, a lower edge, and opposing side edges that extend therebetween, with the upper edge having a greater length than the lower edge. There is also an inner panel having an upper edge, a lower edge, and opposing side edges that extend therebetween, the upper edge having a greater length than the lower edge. Additionally, a pocket is defined between the outer panel and the inner panel and configured to receive an earpiece.

More specifically, in an exemplary embodiment, the outer panel and the inner panel of the audio pouch assembly are coupled together at their respective opposing side edges. The outer panel and the inner panel can alternatively be affixed together at first side edges of their respective opposing side edges and detachably connect proximate a second side edges of their respective opposing side edges. The outer panel has a flap proximate to the second side edge that detachably connects to the second side edge of the inner panel to secure the pouch body about the y-straps of the helmet.

In an alternative embodiment, the outer panel and the inner panel are stitched together at their respective opposing side edges and a portion of their respective lower edges, such that a slit remains for a wire of the earpiece to pass through.

In another exemplary embodiment, the audio pouch assembly has the outer panel coupled to the inner panel together along their respective first side edges. A flap is affixed to the second side edge of the one of either the inner panel or the outer panel and the flap provides releasable attachment to the corresponding second side edge of opposing panel. The flap has an attachment mechanism portion that couples with a corresponding attachment mechanism disposed along the exterior side of the outer panel. Additionally, the inner panel and the outer panel are sized to sandwich the earpiece and the y-straps of the helmet therebetween when the outer panel is folded over the inner panel.

In a detailed aspect of an exemplary embodiment, the upper edge of each panel is longer than the lower edge of each panel. The outer panel and the inner panel are substantially the same size, such that the flap of the inner panel's second side edge wraps around the corresponding second side edge of the outer panel for releasable attachment thereto. In an alternative embodiment, the first side edges of the inner and outer panels are permanently affixed via an edge binding, or the first side edges of the inner and outer panels are detachably connected to each other. The attachment mechanism of the flap and corresponding outer panel edge can be a hook and loop fastener.

In yet another exemplary embodiment, the audio pouch assembly has a pouch body having an outer panel, an intermediate panel, and a pocket panel. A pair of buckle buttons are disposed proximate in opposing upper corners of the pouch body and configured to receive the straps of the helmet. There are a pair of grommets, stitched to the intermediate panel, for receiving the buckle buttons. These grommets have a raised section disposed about an aperture for receiving a cap of the buckle button. Each grommet has a planar peripheral portion being sandwiched between the outer panel and the intermediate panel, such that the raised section extends through an aperture disposed on outer panel. The audio pouch assembly further has a retaining member extending across the pouch body, below the buckle buttons for securing the pouch body to the straps of the helmet. The retaining member is secured along its ends to form a pass through for the straps of the helmet. An edge binding is disposed about the periphery of the pouch body for securing the retaining member along the ends thereof and also for securing together the outer panel, the intermediate panel, and the pocked panel.

Each grommet is configured to stretch its aperture to enable a cap of the buckle button to pass through, and return to its original size to secure about a post of the buckle button, thereby keeping the buckle button secured to the pouch body. The buckle buttons have a post disposed between a buckle portion and the cap, and the buckle portion defines slits at opposing ends thereof for helmet straps to pass therethrough, such that the buckle buttons can secure the straps thereto. The buckle portion also has a raised central bar having ridges in order to provide additional frictional retention of the helmet straps.

In a detailed aspect of an exemplary embodiment, the pocket panel forms a recess having an upper and lower opening for receiving an earpiece, where the upper opening is wider than the lower opening. The lower opening is sized to enable an earpiece wire to pass through. Alternatively, the recess of the pocket panel could have only one opening.

The retaining member can be formed of webbing material and the pocket panel can be formed of stretch mesh material, having rolled edge seams along the upper and lower sides with zig-zag stitching.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
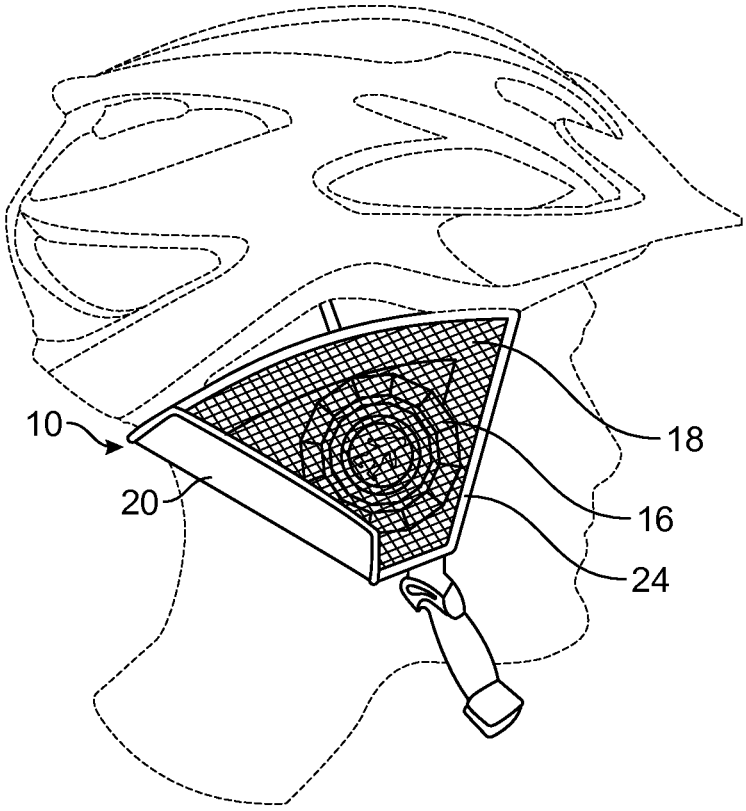
FIG. 1 is a side perspective view of an audio pouch assembly in accordance with the present invention, depicting the audio pouch coupled about v-straps of a protective helmet, and having an earpiece of a headphone assembly secured therein.

Referring now to the drawings, and particularly FIG. 1, there is shown an audio pouch assembly 10 attached to straps of a protective helmet. The audio pouch assembly secures an earpiece of a headphone assembly adjacent to the user's ear when worn. The audio pouch is useable with headphone assemblies disclosed by Applicant's co-pending application, U.S. patent application Ser. No. 13/736,800, filed Jan. 8, 2013, (now U.S. Pat. No. 9,025,806), which is herein incorporated by reference for all purposes.

Figure 2:
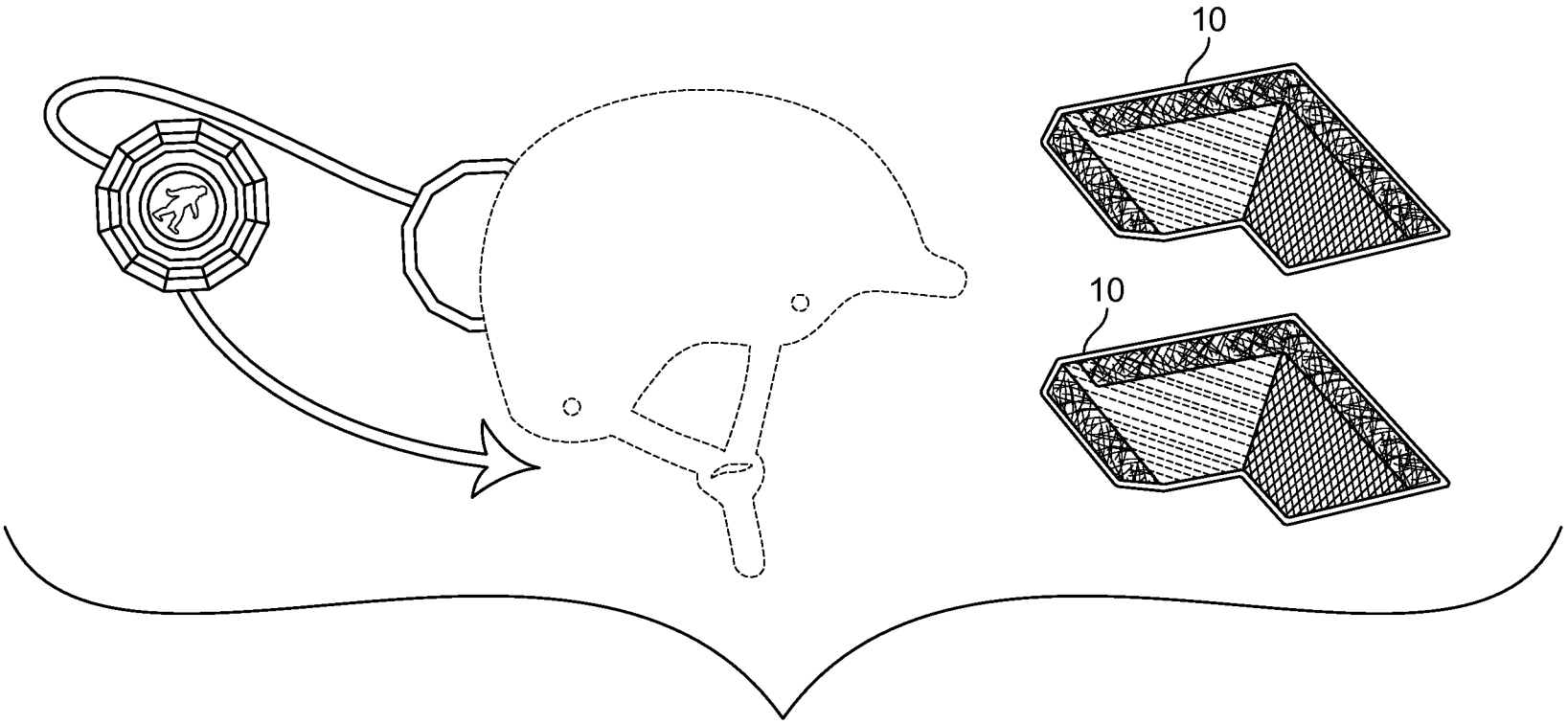
FIG. 2 is an exploded perspective view of the audio pouch assembly, the helmet, and the headphone assembly of FIG. 1.
Figure 3:
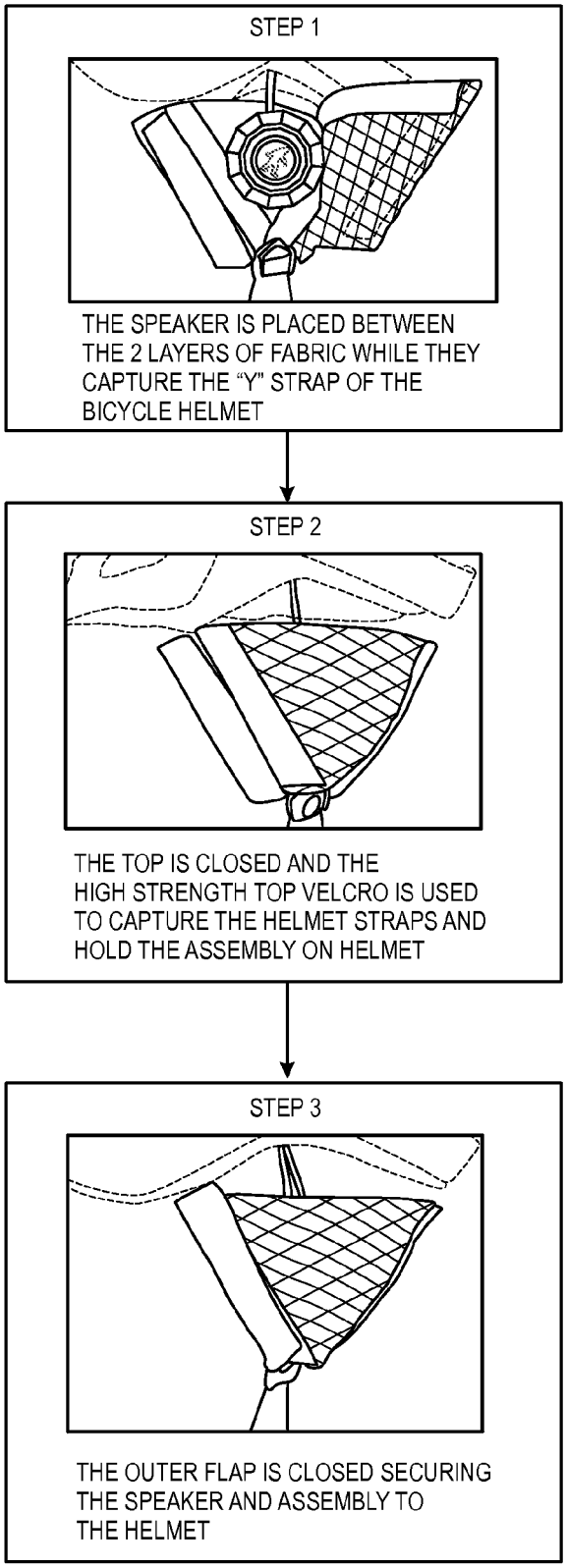
FIG. 3 is a block diagram depicting steps for securing the audio pouch and headphone assembly to the protective helmet.

As shown in FIG. 2, audio pouches 10 are provided on each side of the helmet to secure both earpieces of the headphone assembly. The audio pouch is sized to receive the earpiece and secured in place as well as to securely received the straps and maintain its relative position, while not interfering with the fit, comfort, and safety of the helmet. Moreover, the user can operate control buttons of the earpiece, while in use. With reference now to FIG. 3, the audio pouch can be secured to the helmet with the earpiece in place in a quick and effective manner. The audio pouch includes an inner panel that is disposed adjacent to the user's ear, when worn, and an outer panel. The straps of the helmet as well as the earpiece are sandwiched between the inner panel and the outer panel. The inner panel and the outer panel are coupled together along a first side edge.

As shown in step one, the speaker is placed between the inner panel 14 and the outer panel 16 along with the straps. Thereafter, at step two, attachment mechanisms 18 along an upper portion of the inner panel 14 and outer panel 16 are secured. Next, a flap 20 affixed to a second side edge of the inner panel (4) wraps around and attaches to the corresponding second side edge of the outer panel. The flap and the outer panel include attachment mechanism that enables the flap to be releasably secured to the outer panel, to aid in securing the audio pouch in place.

When to secured in place, the audio pouch has a trapezoidal shape, including an opening at the lower end, which allows the straps extend there through. In addition, a connecting cord of the headphone assembly can extend out of the audio pouch. To remove the audio pouch, the user releases the flap from the outer panel, and releases the attachment mechanism along the upper edge of the inner panel and the outer panel.

Figure 4:
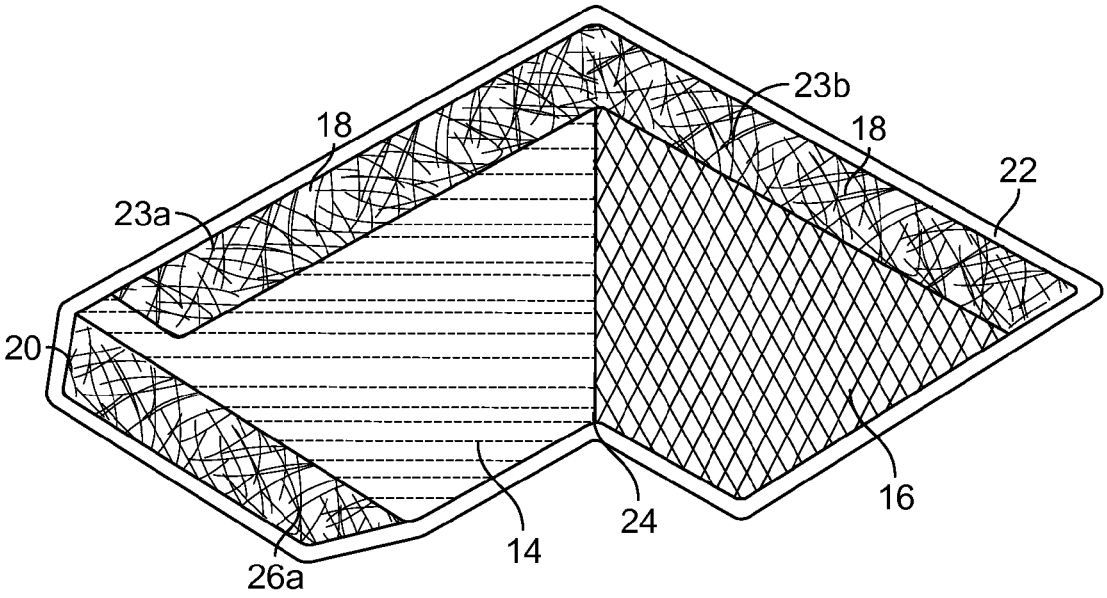
FIG. 4 is an elevational view of the interior side of the audio pouch of FIG. 1.
Figure 5:
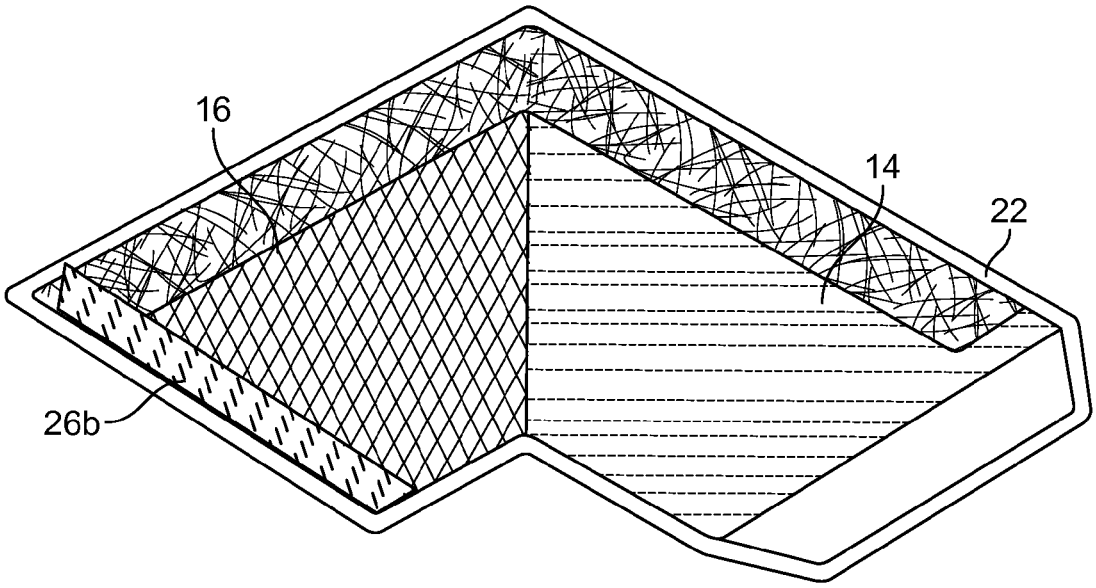
FIG. 5 is an elevational view of the exterior side of the audio pouch of FIG. 1.

With reference now to FIG. 4, an interior side of the audio pouch is shown. As mentioned above, the inner panel 14 is secured to the outer panel 16 along a side edge hinge 24, via an edge binging, that extend the length of both panels. In the exemplary embodiment, the edge binding permanently affixes the panels together along the corresponding edges. In other embodiments, various other approaches can be used to secure the panels together along the corresponding edges.

The inner panel 14 is formed of material that facilitates quality at acoustic performance of the earpiece, while providing performance characteristics needed for maintaining the earpiece in place. The outer panel 16 is formed of material that provides additional structural integrity while allowing the user to manipulate controls of the earpiece. In the exemplary embodiment, the inner panel 14 is formed of a wicking stretch mesh, whereas the outer panel 16 is formed of an outer spacer mesh. In other embodiments, the panels can be formed of the other materials.

Corresponding attachment mechanisms are disposed along the upper end of the inner panel and the outer panel that secure to one another in use. In the exemplary embodiment hook-and-loop fasteners (23, *a, b*) are used (e.g., Velcro®). More particularly, in the exemplary embodiment, high strength hook and loop fastener is employed. In other embodiments, various other fastening mechanisms known to those of ordinary skill in the art can be used without departing from the invention.

The flap 20 includes an attachment mechanism (26*a*) portion that couples with a corresponding attachment mechanism (26*b*) disposed along the exterior side of the outer panel 16. More particularly, in the exemplary embodiment, hook and loop fastener is employed. In other embodiments, various other fastening mechanisms known to those of ordinary skill in the art can be used without departing from the invention. Is further noted that in the exemplary embodiment the higher strength hook and loop fastener 23 is employed along the upper and relative to the hook-and-loop fastener 26 employed with the flap 20.

Figure 6:
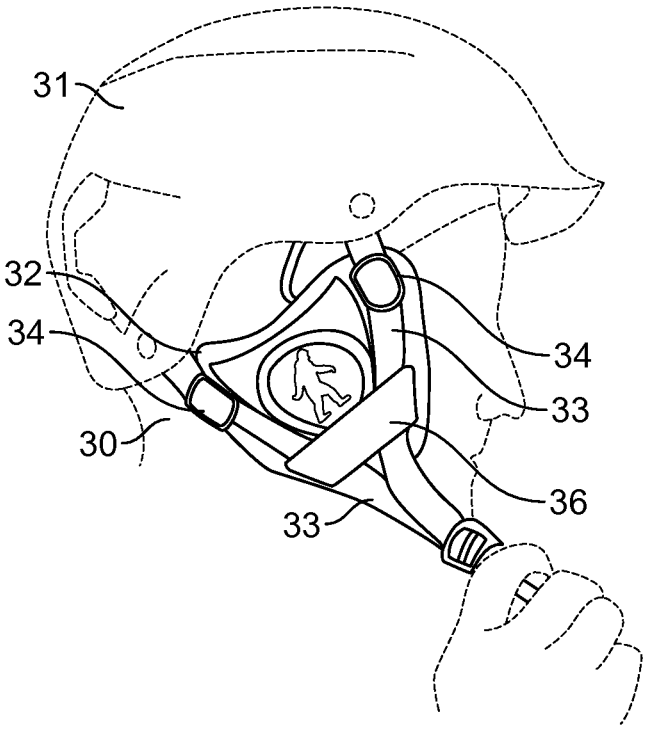
FIG. 6 is a side perspective view of a second embodiment of an audio pouch assembly in accordance with the present invention, depicting the audio pouch assembly having a pouch body and buckle buttons for coupling to v-straps of a protective helmet.

With reference now to FIG. 6, an audio pouch assembly 30 is shown attached to straps of a protective helmet 31. The audio pouches secure earpieces of a headphone assembly adjacent to the user's ear when worn. The audio pouch assemblies 30 are provided on each side of the helmet to secure both earpieces of the headphone assembly. The audio pouch is sized to receive the earpiece and secured in place as well as to securely received the straps and maintain its relative position, while not interfering with the fit, comfort, and safety of the helmet. Moreover, the user can operate control buttons of the earpiece, while in use.

The assembly 30 includes a pouch body 32 and a pair of buckle buttons 34 for receiving the straps 33 of the helmet. In the exemplary embodiment, the buckle buttons 34 are positioned proximate in opposing upper corners of the pouch body. The pouch body 32 further includes a retaining member 36 that extends across the pouch body below the buckle buttons 34 for securing the straps 33 of the helmet.

Figure 7:
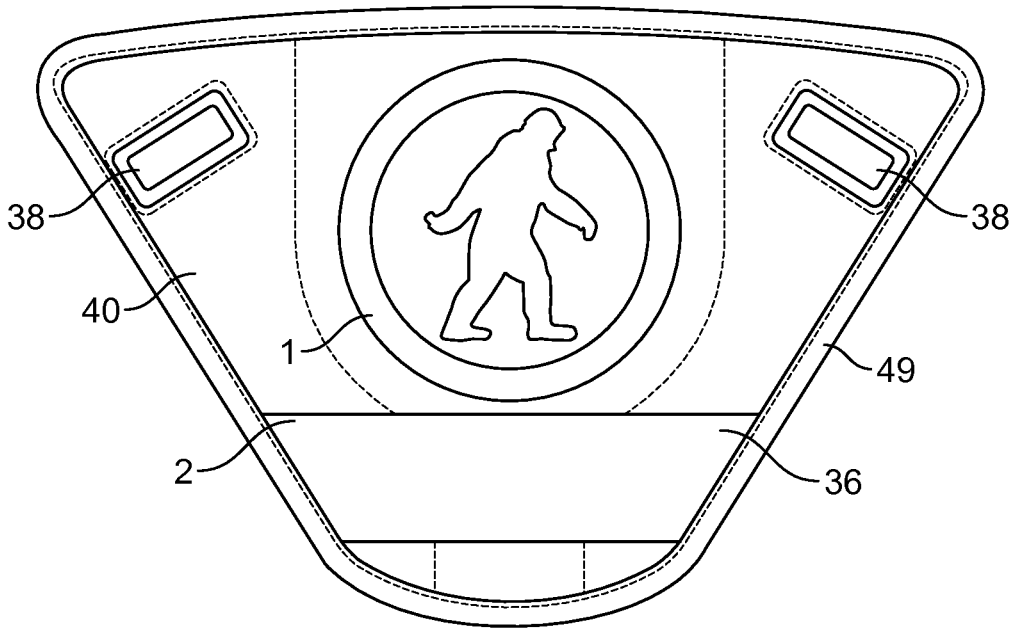
FIG. 7 is a side view of the exterior side of the pouch body of FIG. 6.
Figure 8:
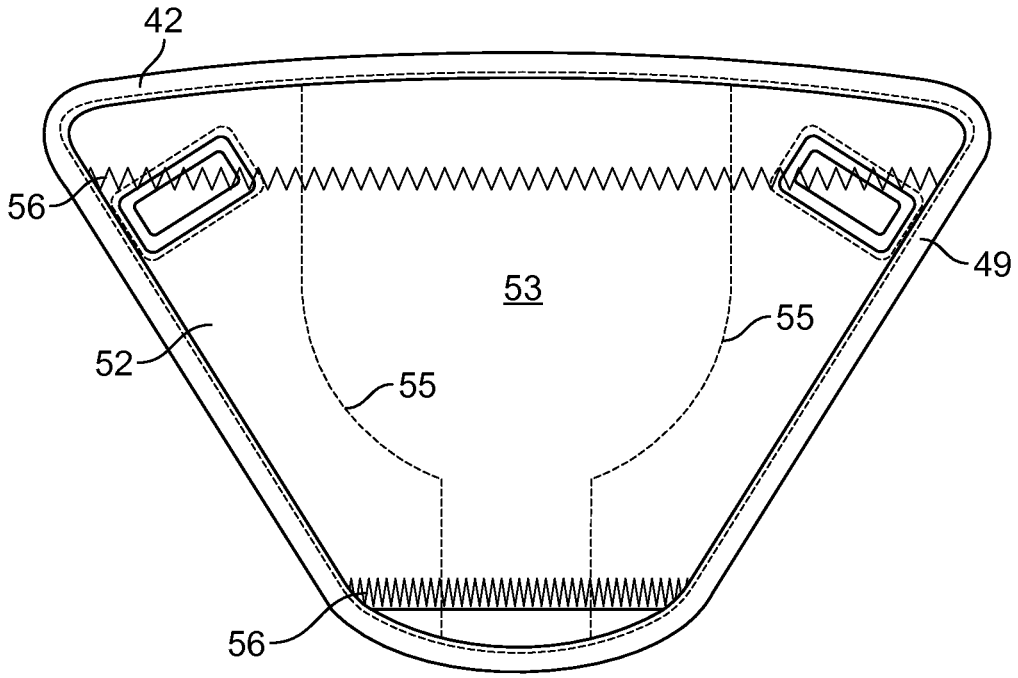
FIG. 8 is a side view of the interior side of the pouch body of FIG. 6.
Figure 9:
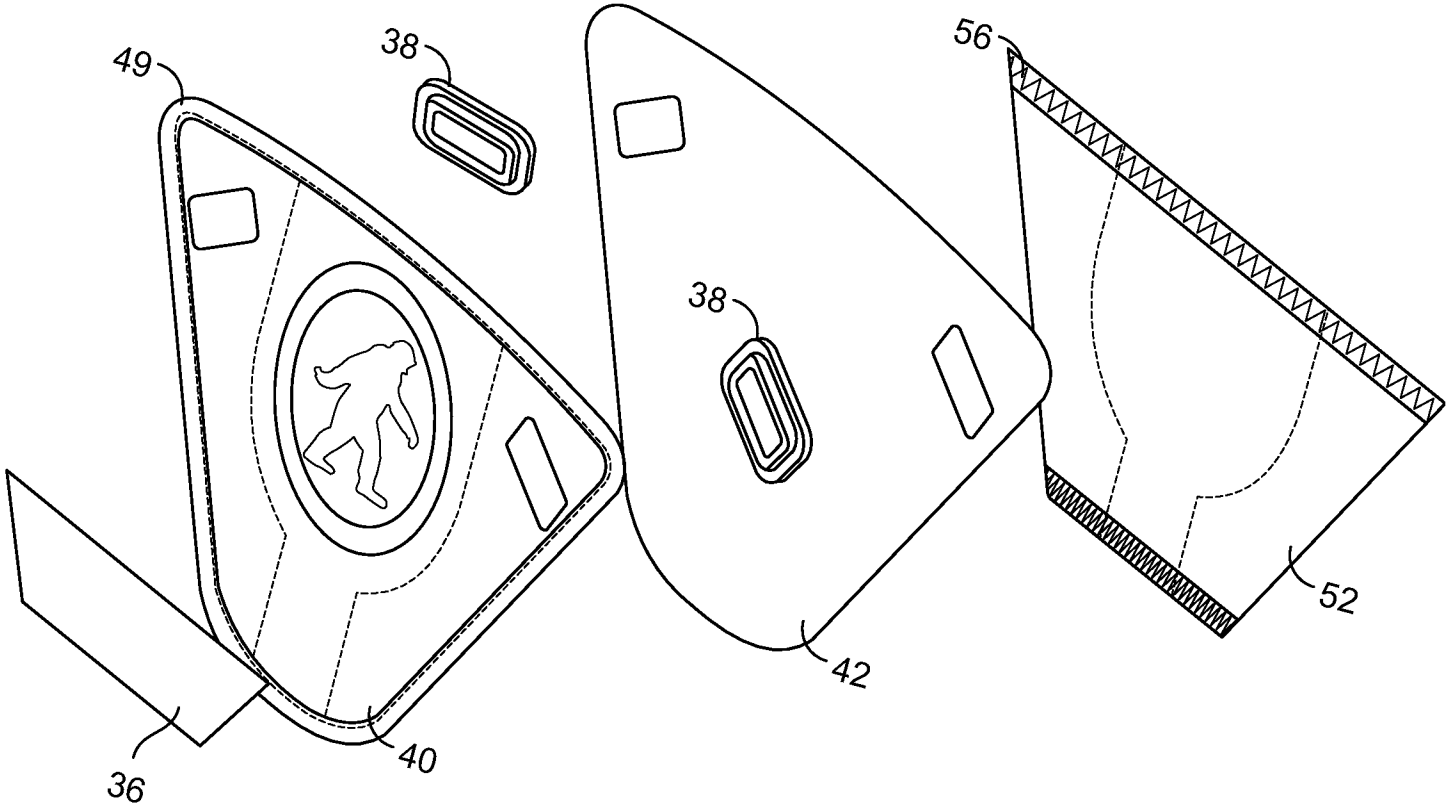
FIG. 9 is an exploded view of the pouch body of FIG. 6.
Figure 10:
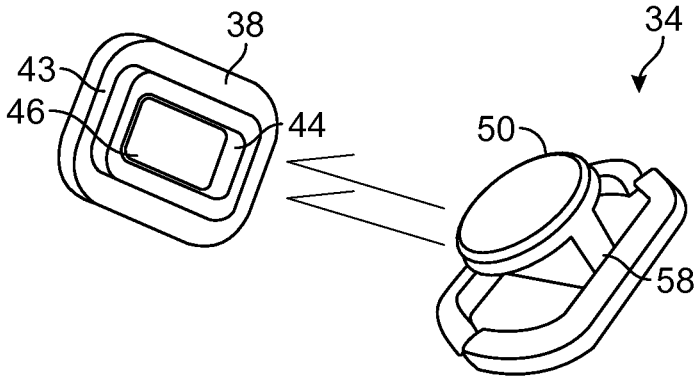
FIG. 10 is a perspective view of a buckle button and grommet of the pouch body of the audio pouch assembly of FIG. 6.

With reference now to FIGS. 7-9, the pouch body 32 includes two grommets 38 for receiving the buckle buttons (see also FIG. 10). In the exemplary embodiment, the grommets are sandwiched between an outer panel 40 and intermediate panel 42 and stitched thereto about the periphery 43 of the grommet. In the exemplary embodiment, the grommets are formed of thermoplastic elastomer (TPE a.k.a. TPR) material.

The pouch body 32 further includes an edge binding 49 disposed about the periphery thereof. The edge binding secures the retaining member 36 along ends thereof. The edge binding also secures together the outer panel 40, the intermediate panel 42, and the pocket panel 52. the retaining member is secured along the ends to form a pass through for the helmet straps 33. In the exemplary embodiment, the retaining member 36 is formed of webbing material. The outer panel can include indicia (e.g., branding (1, 2)) thereon.

As best seen in FIG. 8, the pocket panel 52 contributes to forms a recess 53 for receiving an earpiece. The recess is formed by stitching 55 through the panels (40, 42, 52), forming an upper opening and a lower opening to the recess. The upper opening is wider than the lower opening. The lower opening is sized to enable an earpiece wire to pass through. In other embodiments, only one opening can be provided. The stitching separates the earpiece recess from the grommets 38. The pocket panel 52 is formed of a stretch mesh material, which has rolled edge seams along upper and lower sides with zig-zag stitching 56.

Figure 11A:
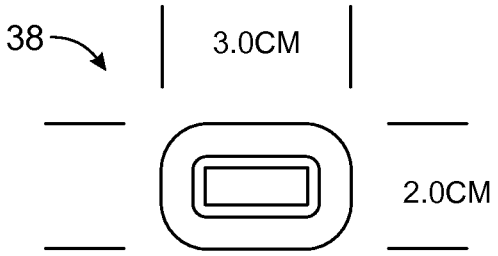
FIGS. 11*a* and 11*b* are plan views of the grommet of the audio pouch assembly of FIG. 6.
Figure 11B:
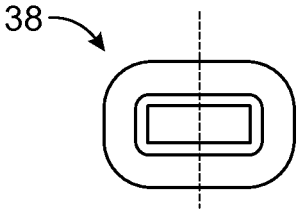
Figure 11C:
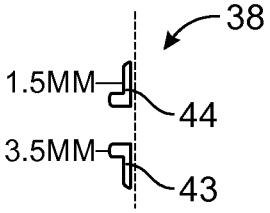
FIG. 11*c* is a cross sectional view of the grommet of the audio pouch assembly of FIG. 6.
Figure 12A:
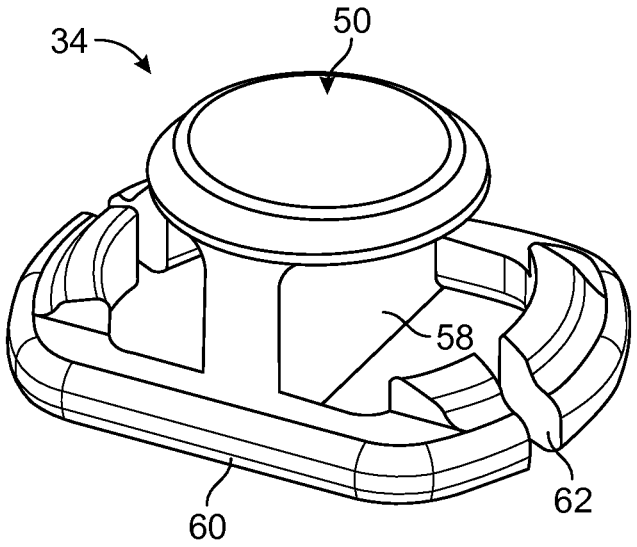
FIG. 12*a* is a perspective view of a button of the audio pouch of FIG. 6.
Figure 12B:
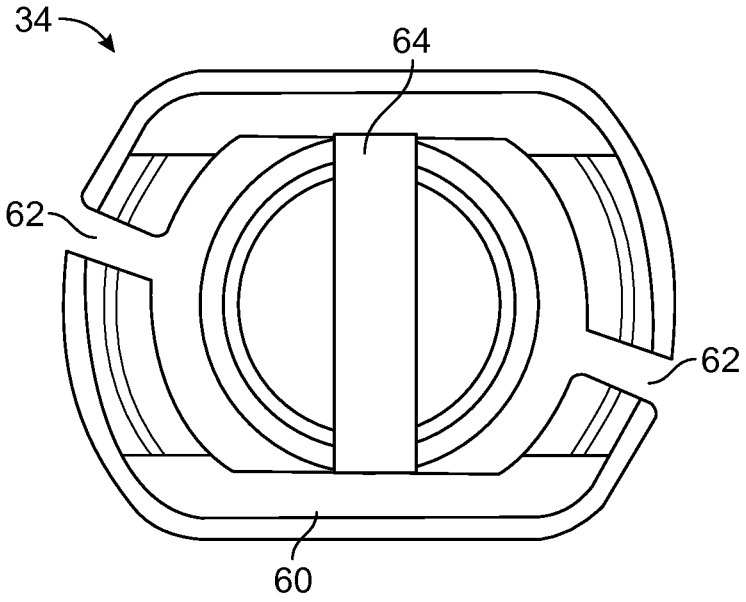
FIG. 12*b* is a top view of the button of FIG. 9.
Figure 12C:
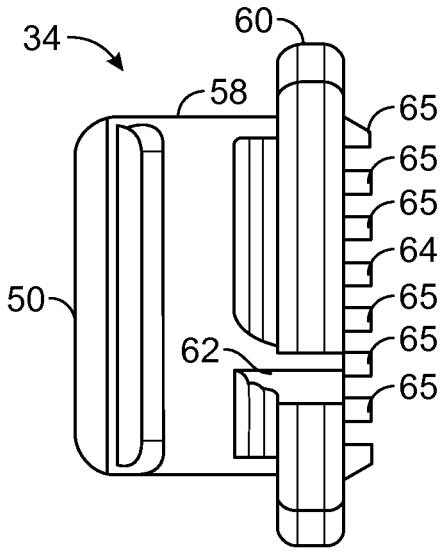
FIG. 12*c* is an end elevational view of the button of FIG. 9.
Figure 12D:
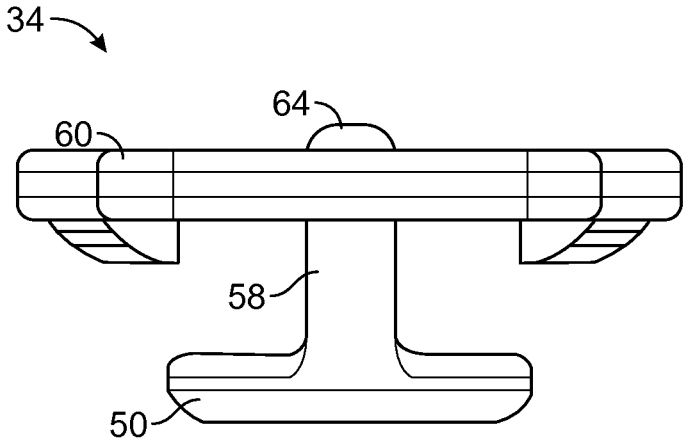
FIG. 12*d* is an side elevational view of the button of FIG. 9.

With reference now to FIGS. 10-11*a-c*, the grommet 38 includes a raised section 44 disposed about an aperture 46 for receiving a cap 50 of the buckle button 34. Each grommet further includes a planar peripheral portion 43 disposed about the raised section 44. The planar peripheral portion is sandwiched between the outer panel 40 and the intermediate panel 42 and is stitched thereto. The grommet is configured that it can stretch its aperture 46 to enable the cap 50 to pass through. Once the cap passes through, the aperture returns to original size to secure about a post 58 of the buckle button 34, thereby keeping the buckle button secured to the pouch body 32.

With reference now to FIGS. 12A-D, the buckle button 34 includes the post 58 disposed between a buckle portion 60 and the cap 50. The buckle portion 60 defines slits 62 at opposing ends thereof. The slits are sized to enable the helmets straps 33 to pass therethrough so that the buckle buttons 34 can secure the straps 33 thereto. The buckle portion includes a raised central bar 64 that aids in creating a friction retention of the strap 33. The central bar 64 include ridges 65 (FIG. 12*c*) that aid in friction retention.

Figure 13A:
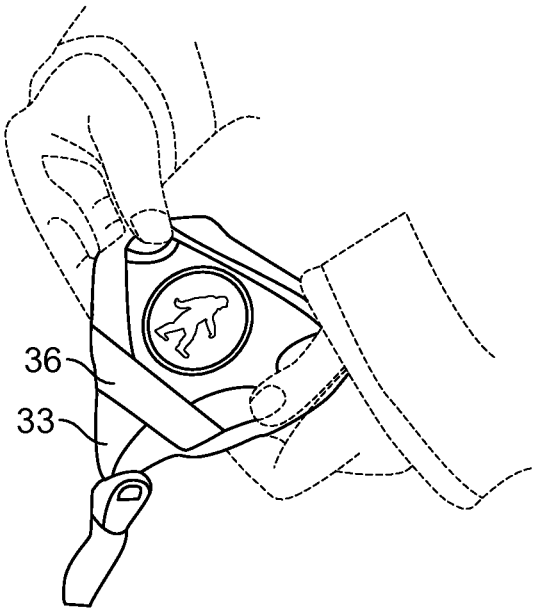
FIGS. 13A-13E is a block diagram depicting steps for securing the audio pouch of FIG. 6 and a headphone assembly to a protective helmet.
Figure 13B:
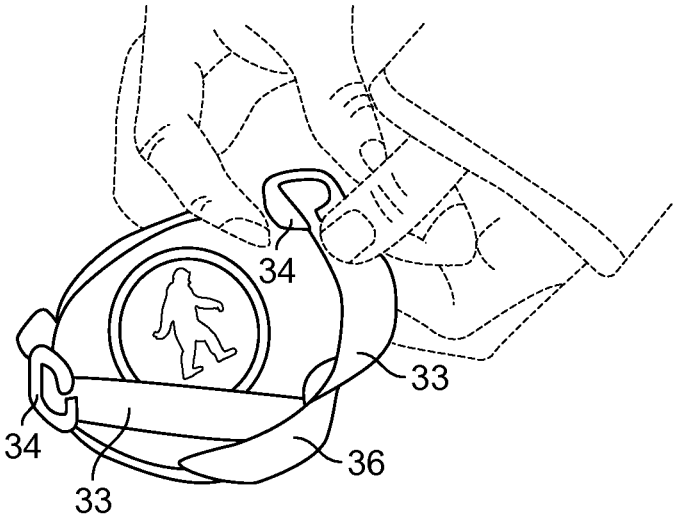
Figure 13C:
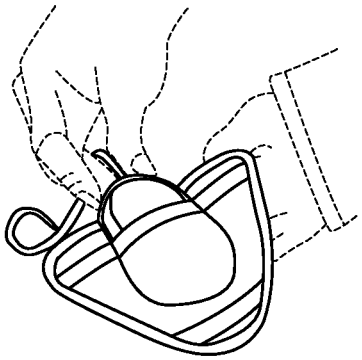
Figure 13D:
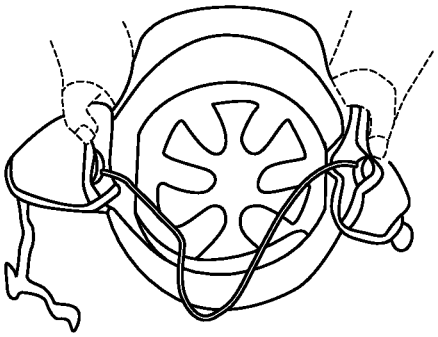
Figure 13E:
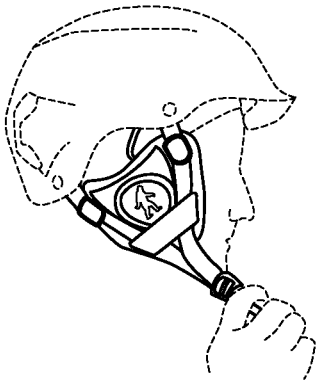

With reference now to FIGS. 13A-C, the audio pouch assembly 30 can be secured to the helmet straps 33 efficiently. As shown in step one, the audio pouch assembly 30 is positioned inside the helmet strap 33, and the strap 33 is threaded through the retaining member 36.

At step two, each strap portion of the y-strap 33 is threaded through the buckle buttons 34. To do so, the strap is passed through the upper and the lower slits 62 of the buckle portion 60. When in place, the strap (a) passes below the upper end of the buckle portion, (b) over the central bar 64, and (c) passes below the lower end of the buckle portion, forming a friction retention of the strap within the buckle.

At step three, the user inserts the earpiece within the recess 53. The wire can be fed inside the helmet. At step four, the prior steps are repeated for the other side of the helmet to provide the result shown in step five.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. An audio pouch assembly for a helmet having y-straps that are disposed proximate to a user's ears when worn to dispose an earpiece over the ear, the audio pouch assembly comprising:

a pouch body having an outer panel, an intermediate panel, and a pocket panel;

a pair of buckle buttons disposed proximate in opposing upper corners of the pouch body and configured to receive the straps of the helmet;

a pair of grommets, stitched to the intermediate panel, for receiving the buckle buttons, the grommets having a raised section disposed about an aperture for receiving a cap of the buckle button; each grommet having a planar peripheral portion being sandwiched between the outer panel and the intermediate panel, such that the raised section extends through an aperture disposed on outer panel;

a retaining member extending across the pouch body, below the buckle buttons for securing the pouch body to the straps of the helmet; the retaining member secured along its ends to form a pass through for the straps of the helmet;

an edge binding disposed about the periphery of the pouch body for securing the retaining member along the ends thereof and also securing together the outer panel, the intermediate panel, and the pocked panel.

2. An audio pouch assembly as defined in claim 1, wherein the pocket panel contributes to form a recess for receiving an earpiece, the recess having an upper opening and lower opening, the upper opening being wider than the lower opening.

3. An audio pouch assembly as defined in claim 1, wherein the lower opening is sized to enable an earpiece wire to pass through.

4. An audio pouch assembly as defined in claim 1, wherein the pocket panel forms a recess for receiving an ear piece, the recess having only one opening.

5. An audio pouch assembly as defined in claim 1, wherein the retaining member is formed of webbing material.

6. An audio pouch assembly as defined in claim 1, wherein the pocket panel is formed of stretch mesh material, having rolled edge seams along the upper and lower sides with zig-zag stitching.

7. An audio pouch assembly as defined in claim 1, wherein each grommet is configured to stretch its aperture to enable a cap of the buckle button to pass through, and return to its original size to secure about a post of the buckle button, thereby keeping the buckle button secured to the pouch body.

8. An audio pouch assembly as defined in claim 1, wherein the buckle buttons have a post disposed between a buckle portion and the cap, the buckle portion defining slits at opposing ends thereof for helmet straps to pass therethrough, such that the buckle buttons can secure the straps thereto.

9. An audio pouch assembly as defined in claim 8, wherein the buckle portion has a raised central bar having ridges to assist in creating a frictional retention of the helmet straps.

* * * * *